US012631173B2

(12) United States Patent
Ma et al.

(10) Patent No.: US 12,631,173 B2
(45) Date of Patent: May 19, 2026

(54) METHOD FOR DETERMINING MALFUNCTION OF A LIQUID DRAINAGE PUMP AND RELATED CONTROL DEVICE AND LIQUID DRAINAGE PUMP

(71) Applicant: Chengli Li, Suzhou (CN)

(72) Inventors: Ke Ma, Suzhou (CN); Erjian Song, Suzhou (CN)

(73) Assignee: Chengli Li, Suzhou (CN)

( * ) Notice: Subject to any disclaimer, the term of this patent is extended or adjusted under 35 U.S.C. 154(b) by 22 days.

(21) Appl. No.: 18/960,391

(22) Filed: Nov. 26, 2024

(65) Prior Publication Data

US 2025/0215873 A1 Jul. 3, 2025

(30) Foreign Application Priority Data

Dec. 28, 2023 (CN) ..... 202311847187.4

(51) Int. Cl.

| | |
|---|---|
| ***F04B 51/00*** | (2006.01) |
| ***F04B 1/0443*** | (2020.01) |
| ***F04B 23/02*** | (2006.01) |
| ***F04B 41/02*** | (2006.01) |
| ***F04B 49/02*** | (2006.01) |
| ***F04B 49/06*** | (2006.01) |
| ***F04B 49/10*** | (2006.01) |

(52) U.S. Cl.

CPC ..... *F04B 51/00* (2013.01); *F04B 49/02* (2013.01); *F04B 1/0443* (2013.01); *F04B 23/02* (2013.01); *F04B 41/02* (2013.01); *F04B 49/065* (2013.01); *F04B 49/10* (2013.01); *F04B 49/103* (2013.01); *F04B 49/106* (2013.01)

(58) Field of Classification Search

CPC combination set(s) only.
See application file for complete search history.

(56) References Cited

U.S. PATENT DOCUMENTS

| | | | | |
|---|---|---|---|---|
| 11,413,860 | B2 * | 8/2022 | Wüstner | F04D 15/0272 |
| 2008/0302111 | A1 * | 12/2008 | Batenburg | F04B 51/00 417/313 |
| 2013/0099931 | A1 * | 4/2013 | Wetherill | G01F 1/34 340/606 |
| 2018/0128705 | A1 * | 5/2018 | Wetherill | G08B 21/182 |
| 2019/0353156 | A1 * | 11/2019 | Ward | F04B 49/065 |
| 2021/0146367 | A1 * | 5/2021 | Szpak | A61H 1/00 |
| 2023/0020473 | A1 * | 1/2023 | Polly | F04B 49/065 |
| 2023/0417235 | A1 * | 12/2023 | Walsh | F04B 49/08 |

* cited by examiner

*Primary Examiner* — Binh Q Tran
(74) *Attorney, Agent, or Firm* — Chen Yoshimura LLP

(57) ABSTRACT

A method for determining malfunction in a liquid drainage pump includes: obtaining a liquid discharge condition during operation of the liquid drainage pump in a first mode, the liquid discharge condition including one or more of a time variation trend of liquid in a liquid storage tank of the liquid drainage pump, start and stop times of the liquid drainage pump, a liquid discharge volume per unit time, and a liquid discharge speed of the liquid drainage pump; determining whether a liquid discharge abnormality occurred based on the liquid discharge condition; and determining that the liquid drainage pump has a malfunction when a statistical number of liquid discharge abnormalities in a continuous time period exceeds a first threshold. The method can quickly determine whether a liquid drainage pump has a liquid discharge malfunction such as a blockage or component damage, and reduce time and effort of manual troubleshooting.

20 Claims, 3 Drawing Sheets

METHOD FOR DETERMINING MALFUNCTION OF A LIQUID DRAINAGE PUMP AND RELATED CONTROL DEVICE AND LIQUID DRAINAGE PUMP

BACKGROUND OF THE INVENTION

This invention relates to the technical field of liquid drainage devices, and in particular, it relates to a method for determining malfunction of a liquid drainage pump, and related pump control device and draining pump.

Liquid drainage pumps (drainage pumps) are used to pump various media (e.g., water or other liquids, etc.) to achieve drainage, and are widely used in various industrial or household applications (e.g., condensation drainage pumps are used in HVAC systems or other systems to drain condensed water or similar liquids, etc.). In some cases, the pump may experience anomalies or other malfunctions. For example, after a period of use, the pump may be blocked by pollutants (e.g., dust, impurities, or other particulate matter, etc.) in the use environment, causing pump anomalies or other malfunctions. In other examples, the pump may not have been properly installed or working properly before it is initially used. These pump malfunctions are not easy to detect and can often cause property losses and/or environmental damage.

In existing technologies, pollutants can be filtered by adding a filter device (e.g. a filter such as a filter screen) to the liquid inlet of the liquid drainage pump. However, the filter device may not be able to filter out all pollutants (for example, small-sized pollutants), so that pollutants may accumulate at other parts of the liquid drainage pump (for example, near the liquid outlet, or near the pump and pump components (for example, the driving device, the pumping element, etc.)), or pollutants (for example, large-sized pollutants) may accumulate near the liquid inlet. In addition, in existing technologies, some liquid drainage pumps are often cleaned regularly (for example, every 1 year, 2 years, etc.) to prevent malfunctions such as blockage. However, this time-based cleaning method may be untimely or excessive.

Therefore, an improved liquid drainage pump is needed.

SUMMARY OF THE INVENTION

Based on the above-discussed defects in the existing technologies, embodiments of the present invention provide a method for determining a malfunction of a liquid drainage pump, a related control device, and a liquid drainage pump.

In a first aspect, the present invention provides a method for determining malfunction in a liquid drainage pump, which includes: obtaining a liquid discharge condition during operation of the liquid drainage pump in a first mode, the liquid discharge condition including one or more of: a time variation trend of liquid in a liquid storage tank of the liquid drainage pump, a start-to-stop time of the liquid drainage pump, a liquid discharge volume per unit time, and a liquid discharge speed of the liquid drainage pump; determining whether a liquid discharge abnormality has occurred based on the liquid discharge condition; and determining that the liquid drainage pump has a malfunction when a statistical number of liquid discharge abnormalities in a continuous time period exceeds a first threshold.

In some embodiments, determining whether a liquid discharge abnormality occurred includes: when a change time of a liquid level in the liquid storage tank of the liquid drainage pump from a first liquid level to a second liquid level lower than the first liquid level exceeds a second threshold value in a single occurrence, determining that a liquid discharge abnormality has occurred.

In some embodiments, determining whether a liquid discharge abnormality occurred includes: when a start-to-stop time of the liquid drainage pump exceeds a third threshold value in a single occurrence, determining that a liquid discharge abnormality has occurred.

In some embodiments, determining whether a liquid discharge abnormality occurred includes: when the liquid discharge volume per unit time or the liquid discharge speed of the liquid drainage pump is less than a fourth threshold value, determining that a liquid discharge abnormality has occurred.

In some embodiments, the statistical number of liquid discharge abnormalities is a number of consecutive occurrences of liquid discharge abnormalities.

In some embodiments, obtaining the liquid discharge condition during operation of the liquid drainage pump in the first mode includes obtaining a time variation trend of a liquid level in the liquid storage tank of the liquid drainage pump; and wherein determining whether a liquid discharge abnormality has occurred and determining that the liquid drainage pump has a malfunction include: when the liquid level in the liquid storage tank of the liquid drainage pump changes from a first liquid level to an alarm level or an overflow level higher than the first liquid level in a single occurrence, determining that a liquid discharge abnormality has occurred and determining that the liquid drainage pump has a malfunction.

In some embodiments, the method further includes: after at least one liquid discharge abnormality occurred, obtaining a first fluid characteristic at a first side of a check valve of the liquid drainage pump close to a liquid outlet of the liquid drainage pump and a second fluid characteristic at a second side of the check valve farther away from the liquid outlet during operation of the liquid drainage pump in the first mode; and determining whether a check valve abnormality occurred based on a difference between the first fluid characteristic and the second fluid characteristic; wherein determining that the liquid drainage pump has a malfunction includes: when a statistical number of check valve abnormalities in a continuous time period exceeds a fifth threshold value, determining that the check valve is damaged, and otherwise determining that a liquid inlet filter of the liquid drainage pump is clogged.

In some embodiments, determining whether a check valve abnormality occurred based on the difference between the first fluid characteristic and the second fluid characteristic includes: when the difference between the first fluid characteristic and the second fluid characteristic exceeds a sixth threshold value, determining that the check valve abnormality occurred.

In some embodiments, each of the first and second fluid characteristics includes at least one of a flow rate, a flow velocity, and a pressure.

In some embodiments, the method further includes: generating an alarm or malfunction signal to indicate at least one of: a malfunction of the liquid drainage pump, a component or location of the liquid drainage pump malfunction, and a need to clean the liquid drainage pump.

In some embodiments, the method further includes: transmitting the alarm or malfunction signal to a display device or an alarm output device.

In some embodiments, the method further includes: obtaining a current liquid level of the liquid in the liquid storage tank of the liquid drainage pump; determining whether the current liquid level satisfies a start condition or a stop condition or an alarm condition or an overflow condition; when the current liquid level satisfies the start condition, generating a start signal to start the liquid drainage pump; when the current liquid level satisfies the stop condition, generating a stop signal to stop the liquid drainage pump; when the current liquid level satisfies the alarm condition or the overflow condition, generating a cut-off signal to stop peripheral device associated with the liquid drainage pump from working.

In some embodiments, the method further includes: obtaining a number of starts and stops of the liquid drainage pump; when the number of starts and stops exceeds a seventh threshold value, generating a self-cleaning signal to cause the liquid drainage pump to perform self-cleaning, including to cause the liquid drainage pump to operate in a second mode by controlling a driving device of the liquid drainage pump to intermittently drive a pumping element of the liquid drainage pump to generate a pulsating liquid flow.

In some embodiments, the method further includes: detecting whether a driving device of the liquid drainage pump is unloaded or stalled; when the driving device is detected to be unloaded or stalled, repeatedly performing following operations until it is determined whether the liquid drainage pump is ready to operate in the first mode: generating a stop signal to stop the liquid drainage pump; after a period of time, generating a start signal to start the liquid drainage pump; detecting whether the driving device is unloaded or stalled; and when a statistical number of unloaded or stalled condition exceeds an eighth threshold value, determining that the liquid drainage pump is not ready to operate in the first mode, and generating a cut-off signal to stop peripheral device associated with the liquid drainage pump from working.

In some embodiments, the method further includes: detecting a first test operation input; and when the first test operation input is detected, generating a test signal to cause the liquid drainage pump to operate in a third mode for a period of time.

In some embodiments, the method further includes: detecting a second test operation input; and when the second test operation input is detected, generating a clearing signal to clear an alarm or malfunction signal, whereby the liquid drainage pump returns to operation in the first mode.

In a second aspect, the present invention provides a control device for controlling a liquid drainage pump, which includes: at least one processor; and a memory configured to store machine-readable instructions, wherein machine-readable instructions are configured to cause the processor to execute any of the above methods.

In a third aspect, the present invention provides a control device for controlling a liquid drainage pump, which includes: an information acquisition unit, configured to acquire a liquid discharge condition during a period when the liquid drainage pump operates in a first mode, wherein the liquid discharge condition includes one or more of: a time variation trend of liquid in a liquid storage tank of the liquid drainage pump, a start-to-stop time of the liquid drainage pump, a liquid discharge volume per unit time, and a liquid discharge speed of the liquid drainage pump; an abnormality determination unit, configured to determine whether a liquid discharge abnormality occurred based on the liquid discharge conditions; and a malfunction determination unit, configured to determine that the liquid drainage pump has a malfunction when a statistical number of liquid discharge abnormalities in a continuous time period exceeds a first threshold.

In a fourth aspect, the present invention provides a drainage liquid pump including the above control device.

The method and devices according to embodiments of the present invention can quickly determine whether a liquid discharge malfunction such as blockage or component damage occurred in the liquid drainage pump, and reduce the time and effort of manual troubleshooting.

BRIEF DESCRIPTION OF DRAWINGS

Preferred embodiments of the present invention are described with reference to the drawings. These drawings explain the embodiments and their operating principle, and only illustrate structures that are necessary to the understanding of the invention. These drawings are not to scale. In the drawings, like features are designated by like reference symbols.

Figure 1:
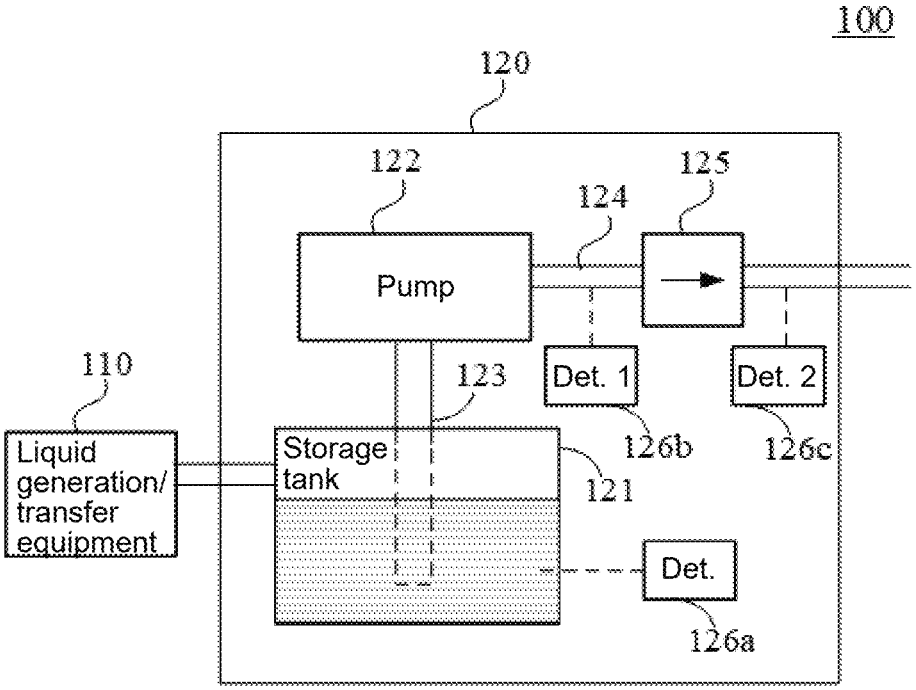
FIG. 1 schematically illustrates a liquid drainage pumping system according to an embodiment of the present invention.

List of components shown in the drawings: 110 Liquid generation or transfer equipment; 120 Liquid drainage pump device; 121 Liquid storage tank; 122 Pump; 123 Liquid inlet; 124 Liquid outlet; 125 Discharge valve; **126*a* Liquid level detector; 126*b* First fluid detector; 126*c* Second fluid detector; 1221 Control device; 1222 Driving device; 1223 Pumping element; 1224 Alarm output device; 1225 Display device; 1226 Input device; 300 Control device; 310 Processor; 320 memory; 400 Control device; 410 Information acquisition unit; 420 Abnormality determination unit; 430** Malfunction determination unit.

DETAILED DESCRIPTION OF THE INVENTION

Preferred embodiments of the present invention are described below with reference to the drawings. These drawings and descriptions explain embodiments of the invention but do not limit the invention. The described embodiments are not all possible embodiments of the present invention. Other embodiments are possible without departing from the spirit and scope of the invention, and the structure and/or logic of the illustrated embodiments may be modified. Thus, it is intended that the scope of the invention is defined by the appended claims. In the following descriptions, directional terms such as up, down, left, right, front, rear, etc. are relative terms with reference to the orientation of the drawing figures; these terms are used for better understanding of the invention, but they do not limit the scope of the invention.

Before describing the embodiments, some terms used in this disclosure are defined here to help the reader better understand this disclosure.

In the descriptions below, terms such as "one," "one group," etc. do not limit the number of components, but means at least one.

In the descriptions below, terms such as "including" are intended to be open-ended and mean "including without limitation", and can include other contents. "Based on" means "at least partly based on." "An embodiment" means "at least one embodiment." "Another embodiment" means "at least another embodiment," etc. In this disclosure, the above terms do not necessarily refer to the same embodiments. Further, the various features, structures, materials or characteristics may be suitably combined in any of the one or more embodiments. Those of ordinary skill in the art may combine the various embodiments and various characteristics of the embodiments described herein when they are not contrary to each other.

As mentioned above, existing liquid drainage pumps may be clogged due to pollutants in the environment, causing pump abnormality or other malfunctions. Due to the lack of intelligent detection, such pump abnormality or other malfunctions are not easy to discover, and the problem point cannot be quickly located. These problems often cause property loss and/or environmental damage. In addition, after the liquid drainage pump is installed, the pump is often operated directly by adding liquid, or the float is moved to the threshold water level to operate the pump. However, this requires additional manpower because it is impossible to confirm whether the liquid drainage pump is installed correctly or whether it is working properly by self-testing the liquid drainage pump.

In view of this, embodiments of the present invention can quickly determine whether the liquid drainage pump has a malfunction by acquiring and analyzing the liquid discharge condition of the liquid drainage pump, so as to overcome the above-mentioned deficiencies in the existing technology.

Referring to FIG. 1, an exemplary liquid drainage system 100 according to an embodiment of the present disclosure is shown. The liquid drainage system 100 includes a liquid drainage pump assembly (or simply the liquid drainage pump) 120 and a liquid generation or transfer equipment 110 located upstream of the liquid drainage pump assembly 120. The liquid drainage pump assembly 120 includes a liquid storage tank 121 to collect and store liquid generated or transferred by the upstream liquid generation or transfer equipment 110. The liquid drainage pump assembly 120 also includes a pump 122 having a liquid inlet 123 connected to the liquid storage tank 121 and a liquid outlet 124 connected to a one-way discharge valve 125 such as a check valve. The pump 122 may transfer liquid from the liquid storage tank 121 to the liquid outlet 124 via the liquid inlet 123, and discharge the liquid via the discharge valve 125 to the external environment or another device located downstream of the liquid drainage pump assembly 120, thereby controlling the liquid in the liquid storage tank 121 at a suitable liquid level.

For example, different liquid levels may be set: 1) a start level, at which the pump needs to start working to drain liquid from the liquid storage tank to the outside or downstream equipment, 2) a stop level, at which the pump needs to stop working to stop draining liquid until the liquid level in the liquid storage tank 121 reaches the start level again, 3) an alarm level, at which an alarm is issued to indicate that the liquid level in the liquid storage tank 121 is too high, and it may be necessary to prevent the upstream liquid generation or transfer equipment 110 from continuing to transfer liquid to the liquid storage tank 121, or it may be necessary to troubleshoot the liquid drainage pump assembly 120, 4) an overflow level, at which an alarm is issued to indicate that the liquid level in the liquid storage tank 121 will overflow the liquid storage tank, and it may be necessary to prevent the upstream liquid generation or transfer equipment 110 from continuing to transfer liquid to the liquid storage tank 121, or it may be necessary to troubleshoot the liquid drainage pump assembly 120. Usually, the alarm level and the overflow level are higher than the start level, and the start level is higher than the stop level. The alarm level and the overflow level may be the same level, or may be different levels, with the overflow level being higher than the alarm level. In addition, more levels may be set as needed, such as one or more alarm levels, one or more overflow levels, which are not limited herein.

For example, the liquid drainage pump assembly 120 may include a liquid level detector **126*a* to detect the liquid level of the liquid in the liquid storage tank 121. In some examples, the liquid level detector 126*a* may be a contact detection sensor, for example, by using a plurality of liquid level sensors extending into the liquid storage tank 121 to detect a plurality of different liquid levels (as described above), that is, by detecting the liquid level through contact between the sensor and the liquid. In other examples, the liquid level detector 126*a*** may be a non-contact detection sensor, for example, by using an ultrasonic liquid level switch sensor, a capacitive liquid level switch sensor, or other various non-contact detection sensors to detect a plurality of different liquid levels (as described above), that is, without contact between the sensor and the liquid to detect the liquid level.

For example, the liquid drainage pump assembly 120 may include a first fluid detector **126*b* and a second fluid detector 126*c* to detect liquid properties of the liquid discharged from the pump 122. The first fluid detector 126*b* is disposed on a first side of the discharge valve 125 close to the liquid outlet 124 to detect a first fluid property, and the second fluid detector 126*c* is disposed on a second side of the discharge valve 125 farther away from the liquid outlet 124 to detect a second fluid property. For example, the first and second fluid properties may include but are not limited to flow rate, flow velocity, pressure, and other properties that can characterize the fluid, etc. For example, the first and second fluid detectors 126*b* and 126*c*** may be flow meters or other fluid measuring devices that can measure fluid properties.

Figure 2:
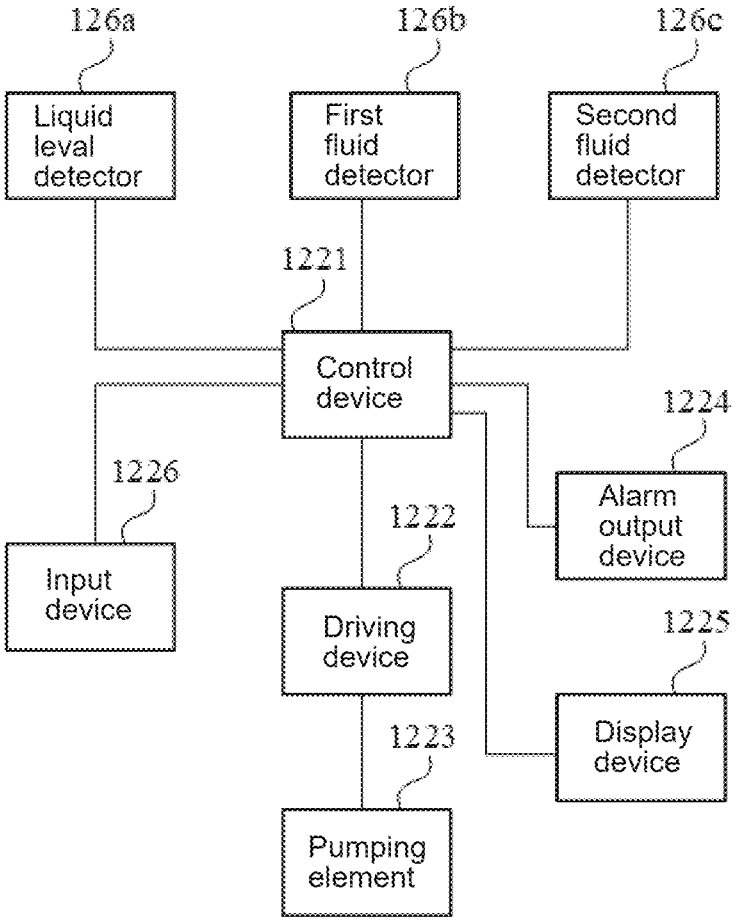
FIG. 2 is a block diagram showing the control system of the liquid drainage pump in FIG. 1.

FIG. 2 shows a control block diagram of the liquid drainage pump assembly 120 of FIG. 1 according to an embodiment of the present invention. As shown in FIG. 2, the liquid drainage pump assembly 120 includes a control device 1221, which may be connected to the liquid level detector **126*a*, the first fluid detector 126*b*, and the second fluid detector 126*c*, so as to obtain the liquid level status of the liquid storage tank 121 from the liquid level detector 126*a*, and obtain the fluid properties of the liquid discharged from the pump 122 from the first fluid detector 126*b* and the second fluid detector 126*c*. For example, the liquid level detector 126*a* may include a plurality of (for example, at least 4) contact liquid level sensors, and the control device 1221 is connected to the plurality of liquid level sensors through a circuit. The control device 1221** receives a square wave signal with a fixed amplitude through the input from the liquid level sensor. When it is detected that the liquid contacts at least two liquid level sensors, the square wave amplitude of the liquid level sensor will change. At this time, the circuit processes the changed signal and transmits it to the control device, thereby determining the liquid level status at this time.

The control device 1221 may also be connected to the driving device 1222 of the pump 122 to drive the pumping element 1223 of the pump 122. For example, the driving device 1222 may be a motor, and the pumping element 1223 may be an impeller or a diaphragm coupled to the driving device 1222. The control device 1221 drives the motor to drive the impeller to rotate or the diaphragm to reciprocate, so that liquid can be extracted from the liquid storage tank 121 and discharged to the environment or downstream equipment.

The control device 1221 may also be connected to the alarm output device 1224 so that the alarm output device 1224 outputs an alarm signal (e.g., an audible alarm signal, an indicator light alarm signal, or other forms of alarm signals) to indicate that the liquid drainage pump assembly 120 has a malfunction.

The control device 1221 may also be connected to a display device 1225 to display the operating status of the liquid drainage pump assembly 120, such as the liquid level status, fluid characteristics, malfunction indication, the operating status of the pump (or its components, such as the driving device, pumping element, etc.), etc. For example, the display device 1225 may be an LED light, a display screen, or other display devices.

The control device 1221 may also be connected to an input device to obtain various operation inputs to the liquid drainage pump, so as to perform corresponding operations on the liquid drainage pump according to the various operation inputs.

The control device 1221 may include, but is not limited to, a microcontroller unit (MCU), a digital signal processor (DSP), a field programmable gate array (FPGA), or various control units that implement similar functions.

Figure 3:
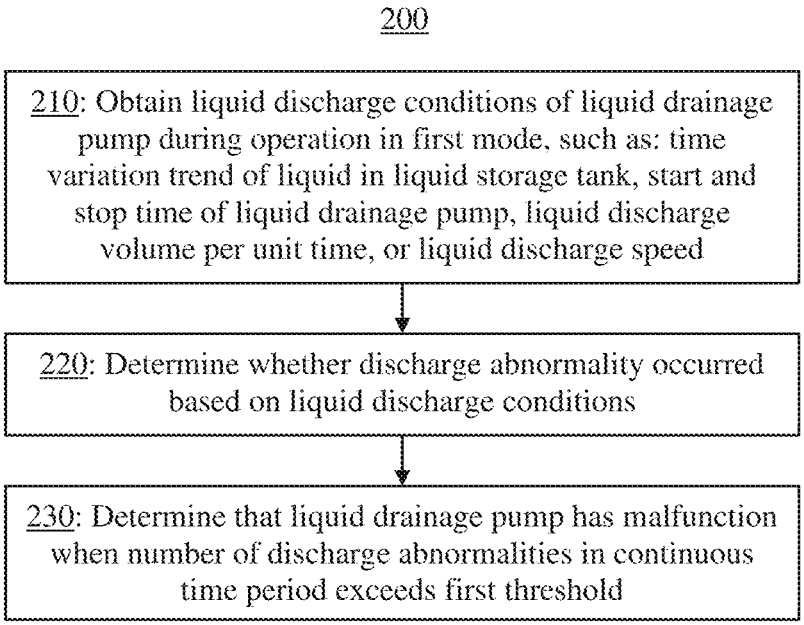
FIG. 3 is a flow chart showing a process of determining a malfunction of the liquid drainage pump according to embodiments of the present invention.

Refer to FIG. 3, which is a flow chart of an exemplary method 200 for determining a malfunction of a liquid drainage pump according to an embodiment of the present invention. The method 200 may be executed by any one of: the control device 1221 of FIG. 2, the control device 300 of FIG. 3, or the control device 400 of FIG. 4. The method 200 includes steps 210-230.

In step 210, the liquid discharge conditions of the liquid drainage pump during operation in the first mode is obtained, where the liquid discharge conditions include one or more of the time variation trend of the liquid in the liquid storage tank of the liquid drainage pump, the start and stop time of the liquid drainage pump, the liquid discharge volume per unit time or the liquid discharge speed of the liquid drainage pump. For example, the first mode may be a normal operation mode of the liquid drainage pump, and the liquid discharge is started when the liquid level of the liquid storage tank 121 reaches the start liquid level, and the liquid discharge is stopped when the liquid level of the liquid storage tank 121 reaches the stop liquid level, and the driving device of the liquid drainage pump is controlled to continuously drive the pumping element to discharge the liquid until the stop liquid level is reached. For example, the liquid level condition of the liquid in the liquid storage tank 121 may be collected or detected over time via the liquid level detector 126*a*, and the control device may determine the time variation trend of the liquid in the liquid storage tank 121 according to the obtained liquid level condition, such as the time for the liquid level to drop from a first liquid level to a second liquid level lower than the first liquid level (for example, using a timer or a counter by starting at the first liquid level and stopping at the second liquid level, etc.). For example, the liquid level condition of the liquid in the liquid storage tank 121 may be collected or detected over time via the liquid level detector 126*a*. When the start liquid level is reached, the pump starts to work to drain the liquid from the liquid storage tank to the outside or downstream equipment. When the stop liquid level is reached, the pump needs to stop working to stop discharging the liquid. The control device may determine the start and stop time of the liquid drainage pump according to the acquired liquid level condition (for example, using a timer or counter by starting at the start liquid level and stopping at the stop liquid level via, etc.), or the control device may directly detect the start and stop time of the pump driving device. For example, the fluid properties of the discharged liquid may be detected via the second fluid detector 126*b*, and the control device may determine the liquid discharge volume per unit time or liquid discharge speed according to the acquired fluid properties.

In step 220, it is determined whether an abnormality in the discharge occurred based on the liquid discharge conditions. For example, when the liquid drainage pump is blocked or in an abnormal condition, the liquid discharge condition usually changes, such as the water level drop time of the liquid storage tank becomes longer, the discharge volume per unit time becomes smaller, or the discharge speed becomes slower. Therefore, it may be determined whether the discharge is abnormal based on the liquid discharge condition.

In step 230, when the number of abnormal discharge conditions (discharge abnormalities) in a continuous time period exceeds a first threshold $TH_1$, it is determined that the liquid drainage pump has a malfunction. For example, the degree of abnormal drainage may be determined based on multiple discharge conditions, thereby preventing the erroneous judgment of drainage malfunction due to single or occasional (for example, non-continuous or non-consecutive) drainage stagnation. This is because the fluid transfer driven by the pumping element may discharge part of the contaminants, thereby eliminating or reducing the drainage stagnation.

As environmental pollutants enter the liquid storage tank and enter the liquid drainage pump through fluid transfer, blockages may occur at various parts of the liquid drainage pump (for example, filters at the liquid inlet, discharge valves at the liquid outlet, pumping elements, driving device, etc.). The above-mentioned method 200 can quickly determine whether the liquid drainage pump has a liquid discharge malfunction such as blockage or component damage, and reduce the time and effort of manual troubleshooting.

In some examples, step 220 may include determining that an abnormal discharge condition occurred when one or more of the following conditions are detected:

1. When the change time of the liquid level in the liquid storage tank of the liquid drainage pump from a first liquid level to a second liquid level lower than the first liquid level exceeds a second threshold value $TH_2$ (a single occurrence), wherein the first liquid level and the second liquid level may be any two liquid levels between the start liquid level and the stop liquid level (including the start liquid level and the stop liquid level);
2. When the start-to-stop time for a single start-to-stop operation session of the liquid drainage pump exceeds a third threshold value $TH_3$, it is determined that the abnormal liquid discharge occurred, that is, the difference between the start time $T_{init}$ and the stop time $T_{stop}$, $|T_{stop}-T_{init}|$ exceeds $TH_3$;
3. When the liquid discharge volume per unit time or the liquid discharge speed of the liquid drainage pump is less than a fourth threshold value $TH_4$, it is determined that an abnormal liquid discharge condition occurred;

4. Or when the discharge parameter values that may be used to determine the abnormality of discharge meet other threshold conditions.

Based on need, abnormal discharge condition may be determined to have occurred either: if a single selected condition is detected to satisfy the above threshold judgment condition, or if among a selected combination of conditions (i.e., multiple conditions), all of or at least half of the conditions are detected to satisfy the above threshold judgment conditions at the same time. For example, combined judgment may more reliably determine whether abnormal discharge condition occurred.

In some examples, the statistical number of liquid discharge abnormality may be used, i.e., based on a number of consecutive abnormal drainage occurrences, thereby preventing erroneous judgment of drainage malfunction due to a single or occasional poor drainage, thereby improving detection reliability.

In some examples, the above step 210 may also include obtaining a liquid level change trend of the liquid in the liquid storage tank of the liquid drainage pump. Furthermore, when the liquid in the liquid storage tank of the liquid drainage pump changes from a first liquid level to an alarm level or an overflow level higher than the first liquid level (a single occurrence), it is determined that a liquid discharge abnormality has occurred, and it is determined that the liquid drainage pump has malfunctioned. For example, when the liquid drainage pump starts to discharge liquid, the liquid level usually continues to drop; but if a serious blockage occurred, the liquid inflow speed may be greater than the liquid discharge speed, resulting in an abnormal water level rise, for example, from the first liquid level (which may be a starting liquid level or a liquid level lower than the starting liquid level) to an alarm liquid level or an overflow liquid level higher than the first liquid level. At this time, it may be directly determined that the liquid drainage pump has a serious malfunction.

In some examples, the method 200 may further include the following steps: After at least one liquid discharge abnormality occurred, obtain a first fluid characteristic at a first side of the check valve of the liquid drainage pump close to the liquid outlet and a second fluid characteristic at a second side of the check valve farther away from the liquid outlet during the operation of the liquid drainage pump in the first mode; determine whether a check valve abnormality occurred based on the difference between the first fluid characteristic and the second fluid characteristic. The above step 230 may further include: when the statistical number of check valve abnormalities in a continuous time period exceeds a fifth threshold value $TH_5$, determine that the check valve is damaged, otherwise determine that the liquid inlet filter of the liquid drainage pump is clogged. For example, in addition to the clogging of the inlet filter of the liquid drainage pump causing the liquid level to drop too slowly, the check valve at the liquid outlet may also be clogged and damaged, causing the liquid level to drop too slowly. If it is simply determined that a malfunction occurred, the user may not be able to accurately determine whether the inlet filter needs to be cleaned or the check valve needs to be replaced. In this step, by respectively providing the first and second fluid detectors 126*b* and 126*c* at both ends of the check valve, the detected fluid characteristics may be compared to determine whether a check valve abnormality occurred, and the degree of abnormality of the check valve may be determined based on the fluid characteristics of the discharge of the check valve for multiple times, thereby preventing the erroneous judgment of a damaged check valve due to the fluid characteristics measurement results in a single or occasional (for example, non-continuous or non-consecutive) occurrence. If it is determined that the check valve is damaged, it may be determined that the malfunction of the liquid drainage pump is caused by the damaged check valve. On the contrary, if it is determined that the check valve is not damaged, it may be determined that the malfunction of the liquid drainage pump is caused by the blockage of the liquid inlet filter. Similar to the liquid discharge abnormalities, the statistical number of check valve abnormalities may be the number occurrences of check valve abnormalities. For example, the first and second fluid characteristics may be collected in consecutive single start-to-stop draining sessions, and whether the check valve is damaged may be determined based on the collected first and second fluid characteristics.

For example, based on the difference between the first fluid characteristic and the second fluid characteristic, determining whether the check valve abnormality occurred may include: when the difference between the first fluid characteristic and the second fluid characteristic exceeds a sixth threshold value $TH_6$, determining that the check valve abnormality occurred. For example, the first and second fluid characteristics may include but are not limited to flow rate, flow velocity, pressure, and other characteristics that may characterize the fluid, and the like.

In some examples, method 200 may further include the following steps: based on a determination that the liquid drainage pump has malfunctioned, generating an alarm or malfunction signal to indicate at least one of the following information: a malfunction of the liquid drainage pump, the component or location of the liquid drainage pump malfunction (e.g., liquid inlet/liquid inlet filter, liquid outlet/liquid outlet drain valve, etc.), and the liquid drainage pump needs to be cleaned (i.e., indicating that the liquid drainage pump is clogged).

In some examples, the method 200 may further include the following steps: transmitting the alarm or malfunction signal or information to a display device or an alarm output device to present at least one of the above information to a user.

In some examples, method 200 may further include the following steps: obtaining current liquid level information of the liquid in the liquid storage tank of the liquid drainage pump; determining whether the current liquid level information satisfies a start condition or a stop condition or an alarm condition or an overflow condition. For example, when the current liquid level information satisfies the start condition, the control device generates a start signal to start the liquid drainage pump to start draining (for example, the control driving device starts to drive the pumping element to transport the fluid). For example, when the current liquid level information satisfies the stop condition, the control device generates a stop signal to stop the liquid drainage pump (for example, the control driving device stops driving the pumping element to transport the fluid). For example, when the current liquid level information satisfies the alarm condition or the overflow condition, the control device generates a cut-off signal to stop the peripheral device associated with the liquid drainage pump (for example, a fluid generation or transfer device located upstream of the liquid drainage pump) from working (for example, by disconnecting the control signal of the peripheral device, etc.) to prevent the water level in the liquid storage tank from further rising, thereby avoiding property loss and/or environmental damage. In addition, when the current liquid level information satisfies the alarm condition or overflow condition, an alarm signal may also be generated and sent to an alarm output device or a display device to remind the user that the liquid level in the liquid storage tank is too high.

In some examples, method 200 may further include: obtaining the number of starts and stops of the liquid drainage pump, and when the number of starts and stops exceeds the seventh threshold value $TH_7$, generating a self-cleaning signal to make the liquid drainage pump operate in the second mode for self-cleaning. For example, compared with the first mode during normal operation, the second mode may include controlling the driving device of the liquid drainage pump to intermittently drive the pumping element to generate a pulsating liquid flow, which will have certain cleaning effect on the pollutants attached to the check valve near the liquid outlet. After working intermittently for a period of time, the liquid drainage pump is controlled to return to the first mode. For example, the pump may be intermittently operated at high speed for a first time period (for example, 5 seconds), stopped for a second time period (for example, 2 seconds), and repeated multiple times (for example, 10 times). For example, the number of starts and stops may be counted by a counter, and when the seventh threshold value is reached, the counting is restarted (for example, reset, etc.). Compared with the time-dependent pump cleaning method, automatic self-cleaning of the liquid drainage pump according to the number of starts and stops may prevent untimely or excessive cleaning. This is because the accumulation of pollutants is related to the number of times the liquid drainage pump is used. This can achieve timely and efficient cleaning of possible pollutants.

In some examples, the method 200 may further include: detecting whether the driving device of the liquid drainage pump is unloaded or stalled; when the driving device is detected to be unloaded or stalled, repeatedly performing the following operations until it is determined whether the liquid drainage pump is ready to operate in the first mode: generating a stop signal to stop the liquid drainage pump; after a period of time, generating a start signal to start the liquid drainage pump; detecting whether the driving device is unloaded or stalled; when the statistical number of unloaded or stalled condition exceeds an eighth threshold value $TH_8$, determining that the liquid drainage pump cannot work in the first mode, and generating a cut-off signal to stop the peripheral device associated with the liquid drainage pump. For example, the pump of the liquid drainage pump has a motor as a driving device, and the motor's abnormal condition of unloaded or stalled may be determined by detecting the current of the motor. Similar to the abnormal condition of liquid discharge, the degree of abnormality of the motor is determined if unloaded or stalled condition is detected for multiple times in succession, thereby preventing the motor from being incorrectly deemed to be damaged due to a single or occasional (e.g., non-consecutive) unloaded or stalled detection result. In this way, when the control device detects that the pump (or the pump driving device) has a malfunction such as no unloaded or stalled, it will stop working. After a certain period of time, it will automatically try to start again. If it still does not return to normal after a certain number of attempts, the control signal of the peripheral device will be disconnected to ensure that the equipment will not continue to work and there will be no more rising liquid level and overflow, thereby preventing property loss.

In some examples, the method 200 may further include: detecting a first test operation input; and when the first test operation input is detected, generating a test signal to cause the liquid drainage pump to operate in a third mode for a period of time.

In some examples, the method 200 may further include: detecting a second test operation input; and when the second test operation input is detected, generating a clearing signal to clear the alarm or malfunction signal, so the liquid drainage pump returns to operation in the first mode.

For example, the control device may receive the first or second test operation input via an input device (e.g., a test button, a display device with an interactive input interface, etc.), and perform corresponding operations according to the corresponding detected operation input. For example, a test button may be used as an input device. After the user installs the liquid drainage pump, the test button may be pressed. At this time, the first test operation input is detected, and the entire liquid drainage pump will work in the third mode and automatically operate for a period of time (e.g., 7 seconds). The user can understand whether the liquid drainage pump is correctly installed or working properly through simple and safe operations, for example, by observing whether it is discharging or whether the pump is running. For example, when the liquid drainage pump malfunctions, the user can clear the malfunction of the liquid drainage pump according to the prompt of the display or alarm output (e.g., cleaning the filter or replacing the check valve, etc.), and after the malfunction is cleared, the test button may be pressed for several seconds when the liquid drainage pump is ready to resume operation. At this time, the second test operation input is detected, and an alarm or malfunction clearing signal may be generated to return the liquid drainage pump to operation in the first mode.

Figure 4:
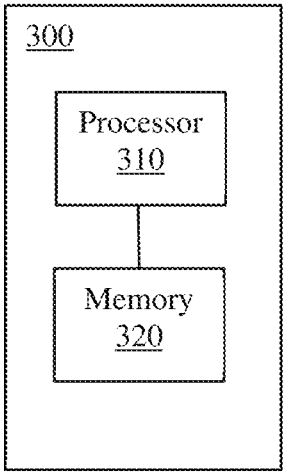
FIG. 4 schematically illustrates a control device for a liquid drainage pump according to an embodiment of the present invention.

Referring to FIG. 4, an exemplary control device 300 for the liquid drainage pump according to an embodiment of the present invention is shown. The control device 300 may be, for example, the control device 1221 of FIG. 2. The control device 300 includes at least one processor 310 and a memory 320 coupled to the processor. The memory 320 stores machine-readable instructions, which, when executed by the at least one processor 310, enable the at least one processor 310 to perform any one or more steps in the method for determining a malfunction of a liquid drainage pump according to embodiments of the present invention (e.g., the above-mentioned method 200).

Figure 5:
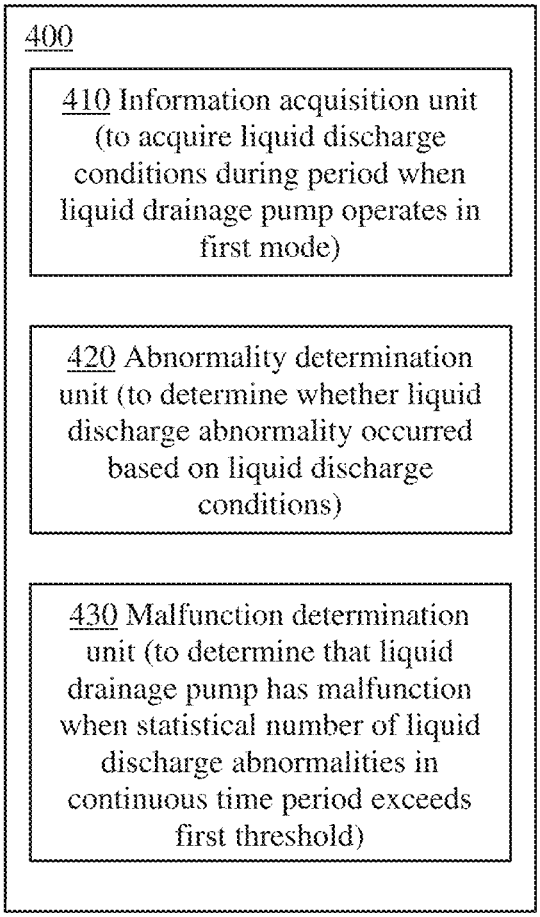
FIG. 5 schematically illustrates another control device for a liquid drainage pump according to another embodiment of the present invention.

FIG. 5 shows another exemplary control device 400 for a liquid drainage pump according to an embodiment of the present invention. The control device 400 may be, for example, the control device 1221 of FIG. 2. The control device 400 includes an information acquisition unit 410, an abnormality determination unit 420, and a malfunction determination unit 430. These units may be implemented, for example, by one or more of an MCU, a DSP, an FPGA, or other suitable control structures.

The information acquisition unit 410 is configured to acquire the liquid discharge conditions during the period when the liquid drainage pump operates in the first mode, where the liquid discharge conditions include one or more of the time variation trend of the liquid in the liquid storage tank of the liquid drainage pump, the start-to-stop time of the liquid drainage pump, the liquid discharge volume per unit time or the liquid discharge speed of the liquid drainage pump.

The abnormality determination unit 420 is configured to determine whether a liquid discharge abnormality occurred based on the liquid discharge conditions.

The malfunction determination unit 430 is configured to determine that the liquid drainage pump has a malfunction when the statistical number of liquid discharge abnormalities in a continuous time period exceeds a first threshold.

In addition, the information acquisition unit 410, the abnormality determination unit 420, and the malfunction determination unit 430 may also be configured to execute corresponding steps in the method for determining a malfunction of a liquid drainage pump according to embodiments of the present invention (e.g., the above method 200), which will not be described in further detail.

In addition, the control device 400 may further include an additional unit configured to execute additional steps in the method for determining a malfunction of a liquid drainage pump according to embodiments of the present disclosure (e.g., the above method 200), which will not be described in further detail.

The present disclosure further provides a liquid drainage pump, comprising any one of the control device 1221, the control device 300 or the control device 400 described above.

While the present invention is described above using specific examples, these examples are only illustrative and do not limit the scope of the invention. It will be apparent to those skilled in the art that various modifications, additions and deletions can be made to the device, system and method of the present invention without departing from the spirit or scope of the invention.

The invention claimed is:

1. A method for determining malfunction in a liquid drainage pump, comprising:

obtaining a liquid discharge condition during operation of the liquid drainage pump in a first mode, the liquid discharge condition including one or more of: a time variation trend of liquid in a liquid storage tank of the liquid drainage pump, a start-to-stop time of the liquid drainage pump, a liquid discharge volume per unit time, and a liquid discharge speed of the liquid drainage pump;

determining whether a liquid discharge abnormality has occurred based on the liquid discharge condition; and determining that the liquid drainage pump has a malfunction when a statistical number of liquid discharge abnormalities in a continuous time period exceeds a first threshold.

2. The method of claim 1, wherein determining whether a liquid discharge abnormality occurred includes:

when a change time of a liquid level in the liquid storage tank of the liquid drainage pump from a first liquid level to a second liquid level lower than the first liquid level exceeds a second threshold value in a single occurrence, determining that a liquid discharge abnormality has occurred.

3. The method of claim 1, wherein determining whether a liquid discharge abnormality occurred includes:

when a start-to-stop time of the liquid drainage pump exceeds a third threshold value in a single occurrence, determining that a liquid discharge abnormality has occurred.

4. The method of claim 1, wherein determining whether a liquid discharge abnormality occurred includes:

when the liquid discharge volume per unit time or the liquid discharge speed of the liquid drainage pump is less than a fourth threshold value, determining that a liquid discharge abnormality has occurred.

5. The method of claim 1, wherein the statistical number of liquid discharge abnormalities is a number of consecutive occurrences of liquid discharge abnormalities.

6. The method of claim 1, wherein obtaining the liquid discharge condition during operation of the liquid drainage pump in the first mode includes obtaining a time variation trend of a liquid level in the liquid storage tank of the liquid drainage pump; and wherein determining whether a liquid discharge abnormality has occurred and determining that the liquid drainage pump has a malfunction include: when the liquid level in the liquid storage tank of the liquid drainage pump changes from a first liquid level to an alarm level or an overflow level higher than the first liquid level in a single occurrence, determining that a liquid discharge abnormality has occurred and determining that the liquid drainage pump has a malfunction.

7. The method of claim 1, further comprising:

after at least one liquid discharge abnormality occurred, obtaining a first fluid characteristic at a first side of a check valve of the liquid drainage pump close to a liquid outlet of the liquid drainage pump and a second fluid characteristic at a second side of the check valve farther away from the liquid outlet during operation of the liquid drainage pump in the first mode; and determining whether a check valve abnormality occurred based on a difference between the first fluid characteristic and the second fluid characteristic;

wherein determining that the liquid drainage pump has a malfunction includes:

when a statistical number of check valve abnormalities in a continuous time period exceeds a fifth threshold value, determining that the check valve is damaged, and otherwise determining that a liquid inlet filter of the liquid drainage pump is clogged.

8. The method of claim 7, wherein determining whether a check valve abnormality occurred based on the difference between the first fluid characteristic and the second fluid characteristic includes:

when the difference between the first fluid characteristic and the second fluid characteristic exceeds a sixth threshold value, determining that the check valve abnormality occurred.

9. The method of claim 8, wherein each of the first and second fluid characteristics includes at least one of a flow rate, a flow velocity, and a pressure.

10. The method of claim 1, further comprising:

generating an alarm or malfunction signal to indicate at least one of: a malfunction of the liquid drainage pump, a component or location of the liquid drainage pump malfunction, and a need to clean the liquid drainage pump.

11. The method of claim 10, further comprising:

transmitting the alarm or malfunction signal to a display device or an alarm output device.

12. The method of claim 1, further comprising:

obtaining a current liquid level of the liquid in the liquid storage tank of the liquid drainage pump;

determining whether the current liquid level satisfies a start condition or a stop condition or an alarm condition or an overflow condition;

when the current liquid level satisfies the start condition, generating a start signal to start the liquid drainage pump;

when the current liquid level satisfies the stop condition, generating a stop signal to stop the liquid drainage pump;

when the current liquid level satisfies the alarm condition or the overflow condition, generating a cut-off signal to stop peripheral device associated with the liquid drainage pump from working.

13. The method of claim 1, further comprising:

obtaining a number of starts and stops of the liquid drainage pump;

when the number of starts and stops exceeds a seventh threshold value, generating a self-cleaning signal to cause the liquid drainage pump to perform self-cleaning, including to cause the liquid drainage pump to operate in a second mode by controlling a driving device of the liquid drainage pump to intermittently drive a pumping element of the liquid drainage pump to generate a pulsating liquid flow.

14. The method of claim 1, further comprising:

detecting whether a driving device of the liquid drainage pump is unloaded or stalled;

when the driving device is detected to be unloaded or stalled, repeatedly performing following operations until it is determined whether the liquid drainage pump is ready to operate in the first mode:

generating a stop signal to stop the liquid drainage pump;

after a period of time, generating a start signal to start the liquid drainage pump;

detecting whether the driving device is unloaded or stalled; and when a statistical number of unloaded or stalled condition exceeds an eighth threshold value, determining that the liquid drainage pump is not ready to operate in the first mode, and generating a cut-off signal to stop peripheral device associated with the liquid drainage pump from working.

15. The method of claim 1, further comprising:

detecting a first test operation input; and when the first test operation input is detected, generating a test signal to cause the liquid drainage pump to operate in a third mode for a period of time.

16. The method of claim 1, further comprising:

detecting a second test operation input; and when the second test operation input is detected, generating a clearing signal to clear an alarm or malfunction signal, whereby the liquid drainage pump returns to operation in the first mode.

17. A control device for controlling a liquid drainage pump, comprising:

at least one processor; and a memory configured to store machine-readable instructions, wherein machine-readable instructions are configured to cause the processor to execute a method of claim 1.

18. A control device for controlling a liquid drainage pump, comprising:

an information acquisition unit, configured to acquire a liquid discharge condition during a period when the liquid drainage pump operates in a first mode, wherein the liquid discharge condition includes one or more of: a time variation trend of liquid in a liquid storage tank of the liquid drainage pump, a start-to-stop time of the liquid drainage pump, a liquid discharge volume per unit time, and a liquid discharge speed of the liquid drainage pump;

an abnormality determination unit, configured to determine whether a liquid discharge abnormality occurred based on the liquid discharge conditions; and a malfunction determination unit, configured to determine that the liquid drainage pump has a malfunction when a statistical number of liquid discharge abnormalities in a continuous time period exceeds a first threshold.

19. A drainage liquid pump comprising a control device of claim 17.

20. A drainage liquid pump comprising a control device of claim 18.

* * * * *